US012064047B2

(12) United States Patent
Riley

(10) Patent No.: US 12,064,047 B2
(45) Date of Patent: Aug. 20, 2024

(54) PORTABLE CLOTHES HANGING ASSEMBLY

(71) Applicant: John Riley, Yoakum, TX (US)

(72) Inventor: John Riley, Yoakum, TX (US)

( * ) Notice: Subject to any disclaimer, the term of this patent is extended or adjusted under 35 U.S.C. 154(b) by 58 days.

(21) Appl. No.: 17/969,172

(22) Filed: Oct. 19, 2022

(65) Prior Publication Data

US 2024/0130551 A1 Apr. 25, 2024
US 2024/0225331 A9 Jul. 11, 2024

(51) Int. Cl.
*A47G 25/14* (2006.01)

(52) U.S. Cl.
CPC ..... *A47G 25/1457* (2013.01)

(58) Field of Classification Search
CPC . A47G 25/1457; A47G 25/743; A47G 25/746
See application file for complete search history.

(56) References Cited

U.S. PATENT DOCUMENTS 1,078,729 A * 11/1913 Hill ..... A47G 25/54 211/115
1,693,827 A * 12/1928 Stoltenberg ..... A47G 25/746 211/163
2,033,430 A * 3/1936 Kirik ..... A47G 25/746 211/95
2,506,467 A * 5/1950 Ragland ..... A47G 25/746 211/95
2,595,837 A * 5/1952 Freeman ..... D06F 93/00 211/163
2,639,820 A * 5/1953 Lee ..... A45D 44/02 211/163
3,472,389 A * 10/1969 Lowe ..... A47G 25/746 211/163
4,121,720 A * 10/1978 Hayes ..... A47F 5/0892 211/113
4,238,062 A * 12/1980 Wheeler ..... A47G 25/1457 294/142
4,266,705 A * 5/1981 Wheeler ..... A47G 25/1457 294/169
D334,481 S * 4/1993 Ramotar ..... D6/322
6,273,277 B1 * 8/2001 Geldenhuys ..... B25H 3/04 211/115
6,454,231 B1 * 9/2002 Fischer ..... B25H 3/025 248/220.31
8,998,010 B1 * 4/2015 Kennedy ..... A47B 43/006 211/85.2
9,492,025 B1 * 11/2016 Wu ..... A47G 25/183
(Continued)

FOREIGN PATENT DOCUMENTS

WO WO2004056236 7/2004

*Primary Examiner* — Shaun R Hurley

(57) ABSTRACT

A portable clothes hanging assembly includes a plurality of brackets attached together to define a wall mount that is attachable to a wall of a room in a building and a hanger extending away from the wall mount. A hanging wheel is rotatably attached to the hanger such that the hanging wheel has a vertical rotational axis. A plurality of hanger supports is provided and each of the hanger supports is suspendable from the hanging wheel. Each of the hanger supports has a plurality of receivers thereby facilitating each of the receivers to receive a respective one of a plurality of clothes hangers. In this way the hanging wheel facilitates the clothes hangers to hang clothes in the absence of a closet.

14 Claims, 5 Drawing Sheets

(56) References Cited

U.S. PATENT DOCUMENTS

| | | | | |
|---|---|---|---|---|
| 9,745,692 | B2 | 8/2017 | Powell | |
| 2005/0023229 | A1 | 2/2005 | Ashley | |
| 2006/0243687 | A1* | 11/2006 | Hilger | A47F 5/02 211/106.01 |
| 2007/0080120 | A1 | 4/2007 | Greiner | |
| 2010/0133217 | A1 | 6/2010 | Wang | |
| 2010/0206827 | A1* | 8/2010 | Heroux | A47G 25/1457 211/116 |
| 2011/0042335 | A1 | 2/2011 | McNicholas | |
| 2017/0156526 | A1 | 6/2017 | Swanson | |

* cited by examiner

PORTABLE CLOTHES HANGING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to clothes hanging device and more particularly pertains to a new clothes hanging device for hanging clothes in the absence of a closet. The device includes a wall mount that is mountable to a wall and a hanger that extends away from the wall mount. The device includes a hanging wheel that is rotatably disposed on the hanger and a plurality of hanger supports that are each suspended from the hanging wheel. Each of the hanger supports has a plurality of receivers for receiving a plurality of clothes hangers.

(2) Description of Related Art Including Information Disclosed Under 37 CFR 1.97 and 1.98

The prior art relates to clothes hanging devices including an organizer system that includes a plurality of wall brackets and a plurality of shelves that are attachable to the wall brackets. The prior art discloses an automated closet device that includes a robotic arm for retrieving clothing. The prior art discloses a closet organizer that comprises a plurality of disks being vertically stacked along a plurality of cords. The prior art discloses a closet organizer that includes a vertical stack of bags for containing personal items in a closet. The prior art discloses a closet organizer that comprises a plurality of stacked shelves that are suspended on a plurality of cords.

BRIEF SUMMARY OF THE INVENTION

An embodiment of the disclosure meets the needs presented above by generally comprising a plurality of brackets attached together to define a wall mount that is attachable to a wall of a room in a building and a hanger extending away from the wall mount. A hanging wheel is rotatably attached to the hanger such that the hanging wheel has a vertical rotational axis. A plurality of hanger supports is provided and each of the hanger supports is suspendable from the hanging wheel. Each of the hanger supports has a plurality of receivers thereby facilitating each of the receivers to receive a respective one of a plurality of clothes hangers. In this way the hanging wheel facilitates the clothes hangers to hang clothes in the absence of a closet.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
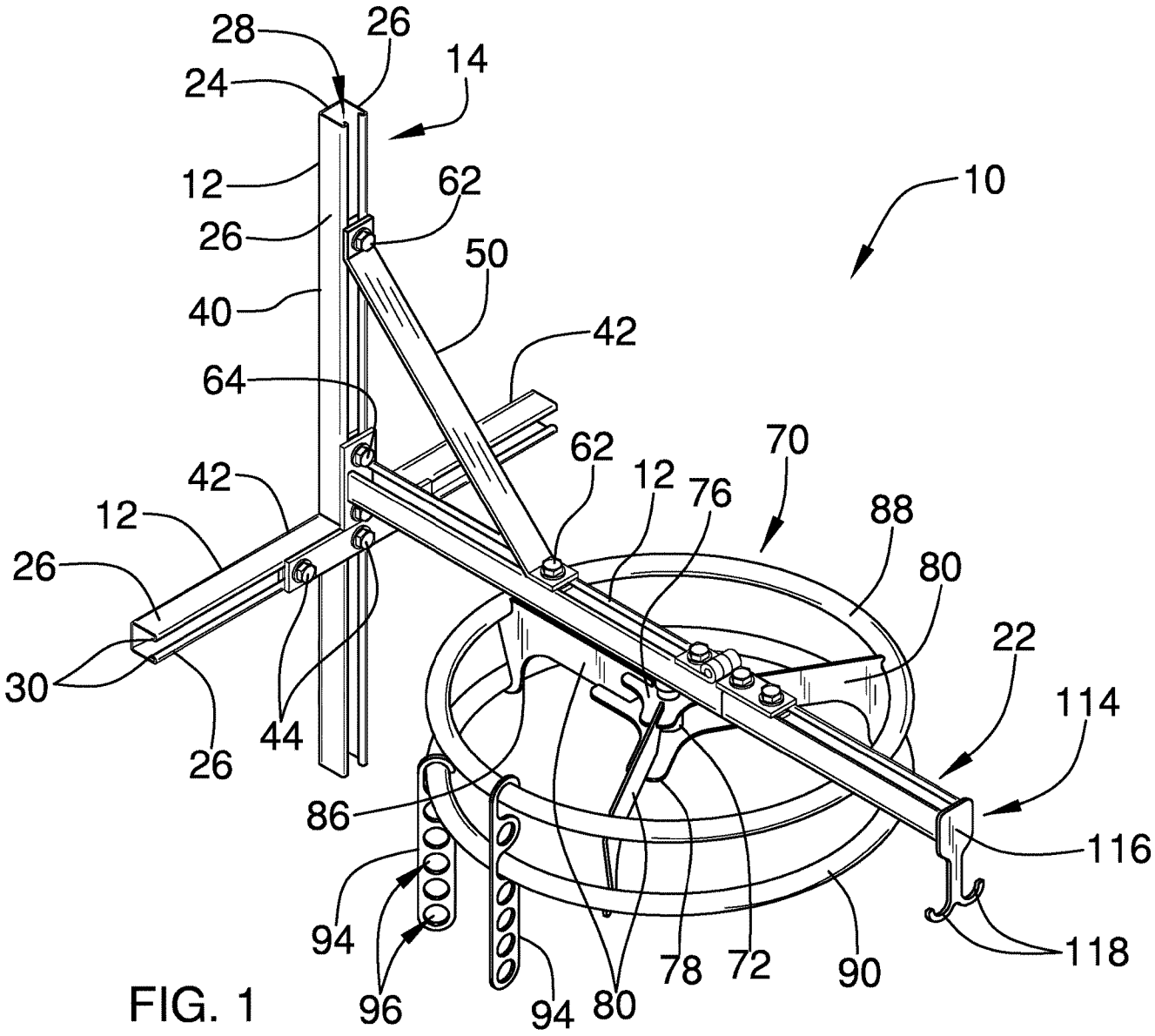
FIG. 1 is a top perspective view of a portable clothes hanging assembly according to an embodiment of the disclosure.
Figure 2:
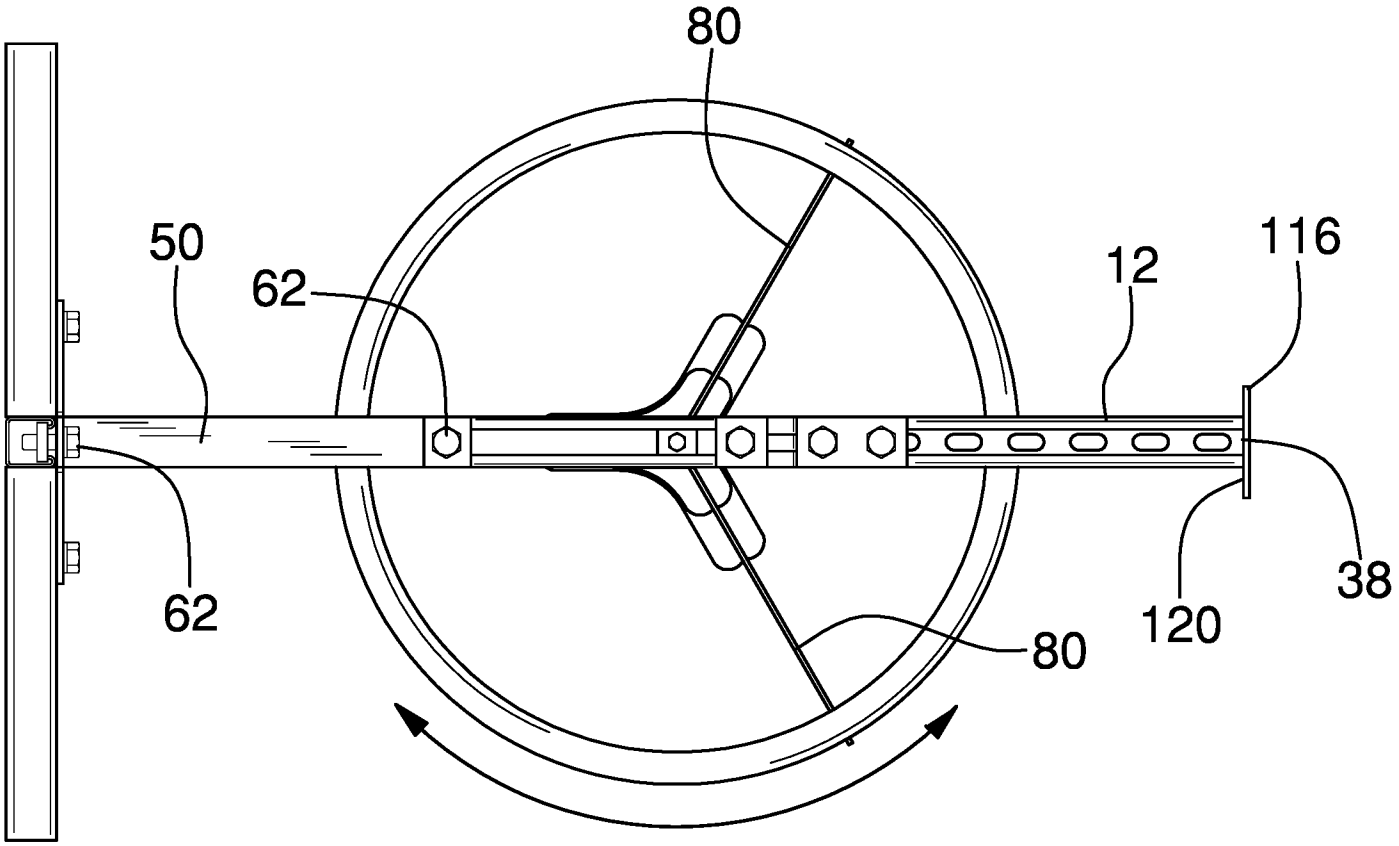
FIG. 2 is a top view of an embodiment of the disclosure.
Figure 3:
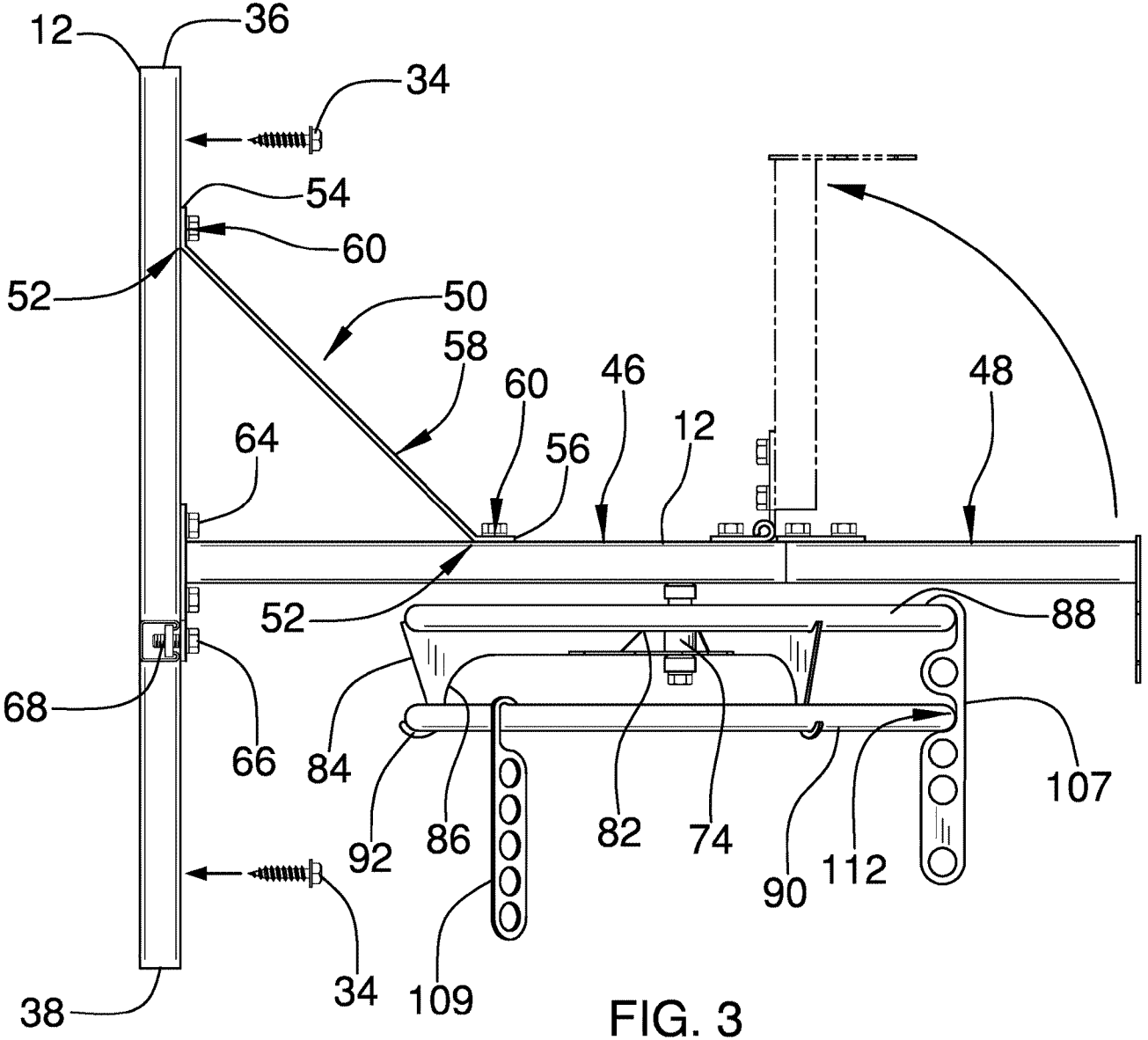
FIG. 3 is a right side view of an embodiment of the disclosure.
Figure 4:
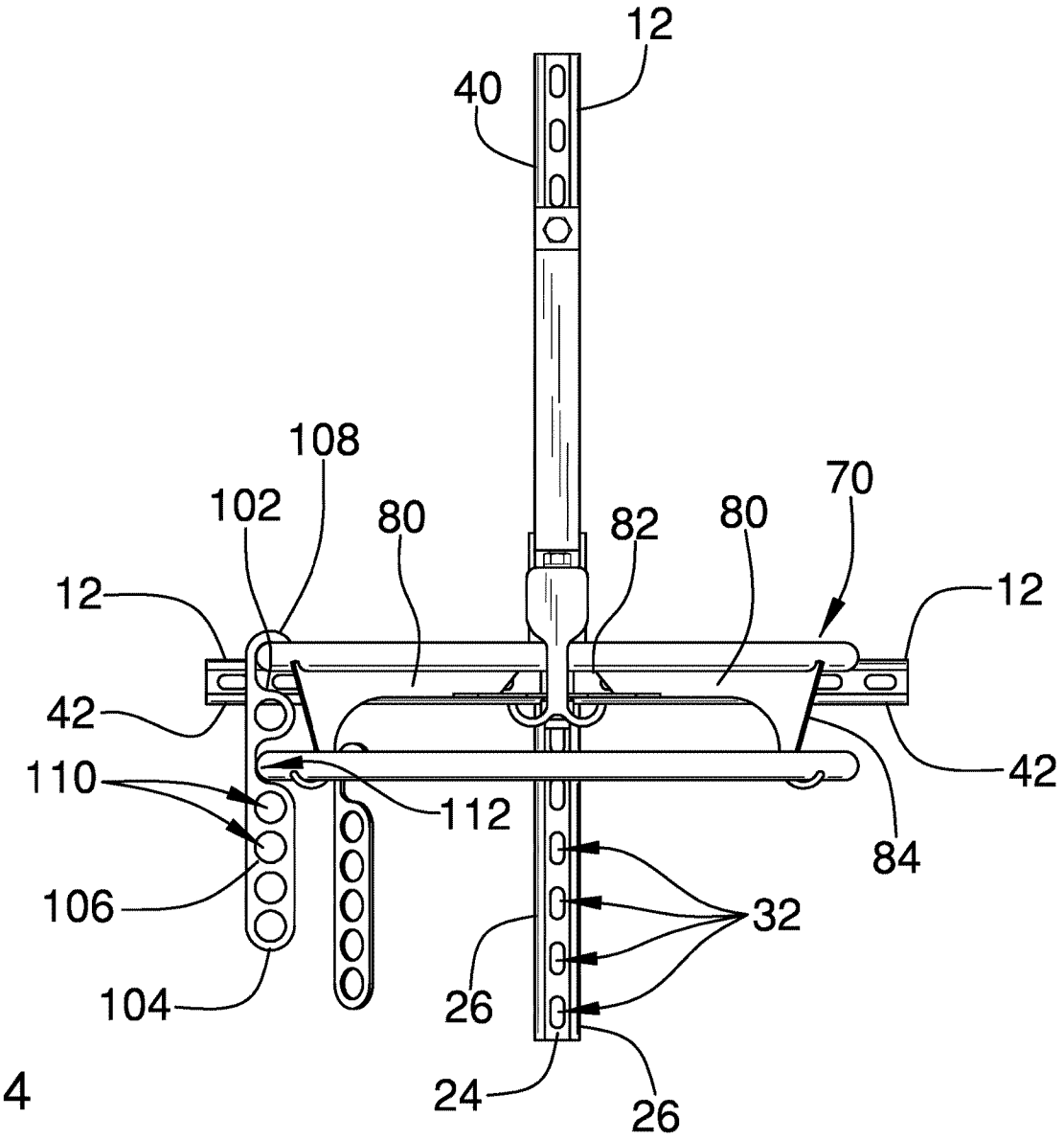
FIG. 4 is a front view of an embodiment of the disclosure.
Figure 5:
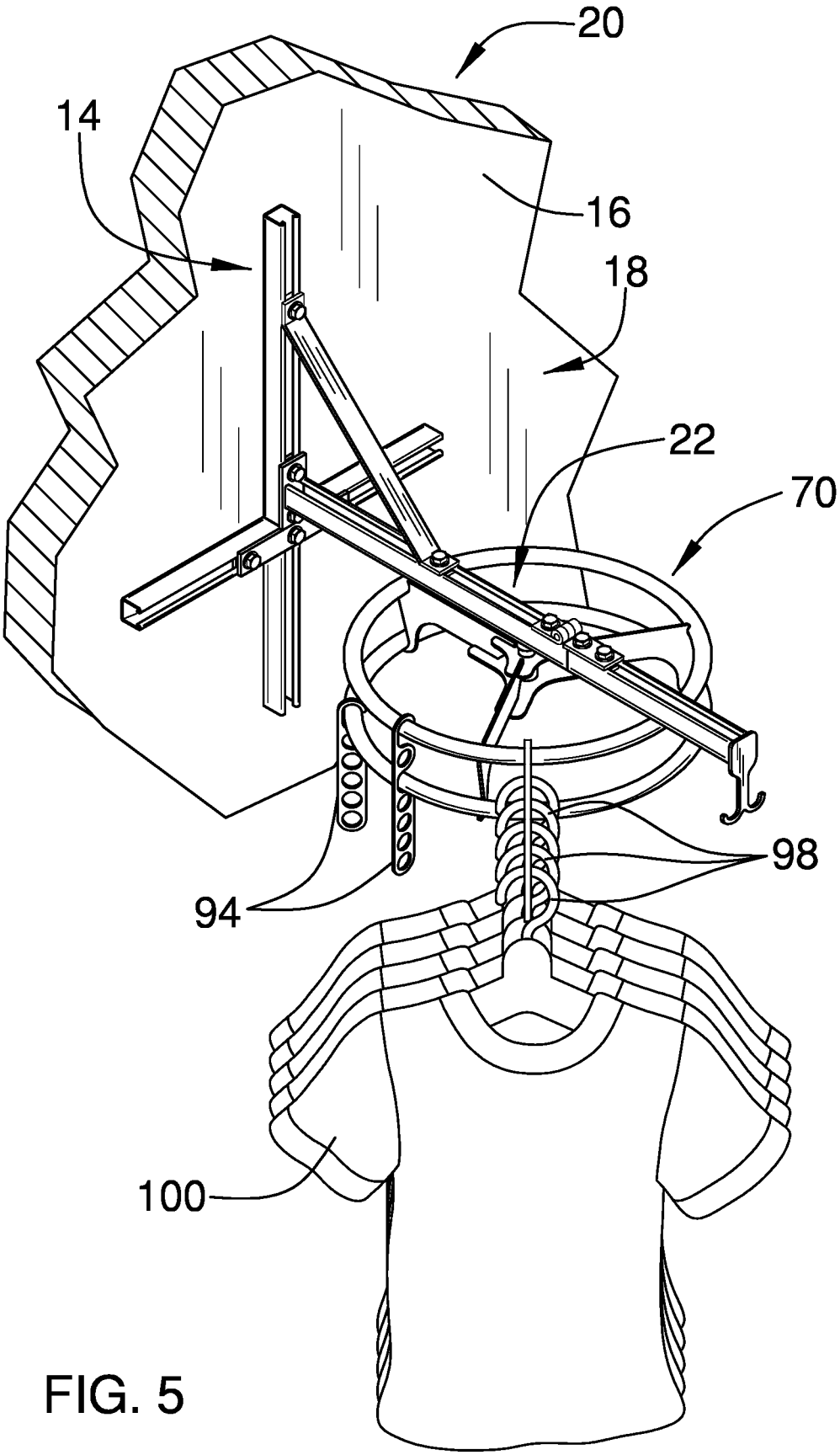
FIG. 5 is a perspective in-use view of an embodiment of the disclosure.

With reference now to the drawings, and in particular to FIGS. 1 through 5 thereof, a new clothes hanging device embodying the principles and concepts of an embodiment of the disclosure and generally designated by the reference numeral 10 will be described.

As best illustrated in FIGS. 1 through 5, the portable clothes hanging assembly generally comprises a plurality of brackets 12 that is attached together to define a wall mount 14 which is attachable to a wall 16 of a room 18 in a building 20 and a hanger 22 extending away from the wall mount 14. The building 20 may be an apartment, a house or other type of occupancy and the room 18 may be a bedroom, for example. Each of the brackets 12 has a first wall 24 and a pair of second walls 26 each extending away from the first wall 24. The second walls 26 are spaced apart from each other and are perpendicularly oriented with the first wall 24 to define a channel 28 between the pair of second walls 26. Each of the second walls 26 has a distal edge 30 with respect to the first wall 24 and each of the second walls 26 is curled toward the first wall 24 at a point located adjacent to the distal edge 30 such that the distal edge 30 of each of second walls 26 is directed toward the first wall 24 of a respective bracket 12.

The first wall 24 of each of the brackets 12 has a plurality of holes 32 extending through the first wall 24 to accommodate a fastener 34 for mounting each of the brackets 12 associated with the wall mount 14 to the wall 16. The fastener 34 may comprise a lag bolt, for example, to engage studs in the wall 16 of other load bearing structures in the wall 16. The holes 32 associated with each of the brackets 12 are spaced apart from each other and are distributed between a first end 36 and a second end 38 of a respective bracket 12. The brackets 12 associated with the wall mount 14 are attached together and are perpendicularly oriented with each other such that the brackets 12 associated with the wall mount 14 define a cross shape. Furthermore, the first wall 24 of each of the brackets 12 associated with the wall mount 14 abuts the wall 16. The brackets 12 associated with the wall mount 14 include a vertically oriented bracket 40 and a pair of horizontally oriented brackets 42. As is most clearly shown in FIGS. 1 and 5, a plurality of fasteners 44 each extends into the channel 28 in the pair of horizontally oriented brackets 42 and the channel 28 in the vertically oriented bracket 40. Each of the horizontally oriented brackets 42 can be positioned at any chosen point along the vertically oriented bracket 40.

The first end 36 of the bracket 12 associated with the hanger 22 is secured to a respective one of the brackets 12 associated with the wall mount 14 such that the bracket 12 associated with the hanger 22 is horizontally oriented having the first wall 24 of the bracket 12 associated with the hanger 22 being directed downwardly. The bracket 12 associated with the hanger 22 includes a first section 46 that is secured to the respective bracket 12 associated with the wall mount 14 and a second section 48 that is hingedly attached to the first section 46. The first end 36 of the bracket 12 associated with the hanger 22 is associated with the first section 46 and the second end 38 of the bracket 12 associated with the hanger 22 is associated with the second section 48. As is most clearly shown in FIGS. 1 and 5, the bracket 12 associated with hanger 22 may be positioned on the vertically oriented bracket 12.

A support 50 is provided which has a pair of bends 52 that is each spaced from a respective one of a respective primary end 54 and a secondary end 56 of the support 50 thereby defining a central portion 58 of the support 50 extending between a pair of end portions 60 of the support 50. Each of the end portions 60 angles away from the central portion 58 and a respective one of the end portions 60 rests against the pair of second walls 26 of a respective one of the brackets 12 associated with the wall mount 14. Additionally, a respective one of the end portions 60 rests against the pair of second walls 26 of the first section 46 of the bracket 12 associated with the hanger 22.

A pair of support attachments 62 is provided and each of the support attachments 62 is attached to a respective one of the end portions 60 of the support 50. A respective one of the support attachments 62 is slidably positioned in the channel 28 defined in a respective one of the brackets 12 associated with the wall mount 14 thereby attaching the support 50 to the wall mount 14. A respective one of the support attachments 62 is slidably positioned in the channel 28 defined in the bracket 12 associated with the hanger 22 such that the bracket 12 associated with the hanger 22 is inhibited from deflecting from the horizontal orientation. Each of the support attachments 62 is retained in the respective bracket 12 by the distal edge 30 of each of the second walls 26 of the respective bracket 12.

A hanger attachment 64 is attached to the first end 36 of the bracket 12 associated with the hanger 22. The hanger attachment 64 is slidably positioned in the channel 28 defined in the bracket 12 associated with the hanger 22 thereby attaching the bracket 12 associated with the hanger 22 to a respective one of the brackets 12 associated with the wall mount 14. Furthermore, the hanger attachment 64 is retained in the bracket 12 associated with the hanger 22 by the distal edge 30 of each of the second walls 26 of the bracket 12 associated with the hanger 22. As is most clearly shown in FIG. 2, each of the support attachments 62 and the hanger attachment 64 may include a bolt 66 that extends into the channel 28 in the respective bracket 12 and a nut 68 positioned in the channel 28 of the respective bracket 12 which threadably engages the bolt 66 and which is abutted against the distal edge 30 of each of the second walls 26 of the respective bracket 12.

A hanging wheel 70 is provided and the hanging wheel 70 is rotatably attached to the hanger 22 such that the hanging wheel 70 has a vertical rotational axis. The hanging wheel 70 comprises a hub 72 that is rotatably coupled to the first wall 24 of the bracket 12 associated with the hanger 22. The hub 72 is positioned on the first section 46 of the bracket 12 associated with the hanger 22 at a point located adjacent to the second section 48 of the bracket 12 associated with the hanger 22. The hub 72 may include a spindle 74 extending between an upper plate 76 of the hub 72 and a lower plate 78 of the hub 72.

The hanging wheel 70 includes a plurality of arms 80 that each has a coupled end 82 which is coupled to the hub 72 and a distal end 84 with respect to the hub 72. The arms 80 are spaced apart from each other and are distributed around the hub 72. Each of the arms 80 has a foot 86 extending downwardly from a respective arm 80 and the foot 86 is aligned with the distal end 84. The hanging wheel 70 includes a first ring 88 that is attached to the distal end 84 of each of the arms 80 such that the first ring 88 surrounds the hub 72. The hanging wheel 70 includes a second ring 90 that is attached to the foot 86 on each of the arms 80 such that the second ring 90 is positioned beneath the first ring 88. As is most clearly shown in FIG. 3, the foot 86 on each of the arms 80 may be curved away from the respective arm 80 to define a hook 92 upon which the second ring 90 is supported.

A plurality of hanger supports 94 is included and each of the hanger supports 94 is suspendable from the hanging wheel 70. Each of the hanger supports 94 has a plurality of receivers 96 thereby facilitating each of the receivers 96 to receive a respective one of a plurality of clothes hangers 98 to facilitate the clothes hangers 98 to hang clothes 100 in the absence of a closet. In this way clothing 100 can be hung in an orderly fashion when a closet is not available to hang the clothing 100. Each of the hanger supports 94 has an upper end 102, a lower end 104 and an outer surface 106 extending between the upper end 102 and the lower end 104 and each of the hanger supports 94 is elongated between the upper end 102 and the lower end 104. Each of the hanger supports 94 has a hook 108 extending upwardly from the upper end 102 and curving downwardly toward the upper end 102 thereby facilitating the hook 108 on each of the hanger supports 94 to rest on a respective one of the first ring 88 or the second ring 90.

Each of the hanger supports 94 has a plurality of holes 110 each extending through the outer surface 106 of the hanger supports 94 to define the plurality of receivers 96 in each of the hanger supports 94. The holes 32 in each of the hanger supports 94 are spaced apart from each other and are distributed along the hanger supports 94. The plurality of hanger supports 94 includes a set of upper hanger supports 107 and a set of lower hanger supports 109. Each of the upper hanger supports 107 has a cut out 112 extending into the upper hanger supports 107 and the cut out 112 is spaced from the hook 108 on a respective upper hanger support 108. Furthermore, the cut out 112 in each of the upper hanger supports 107 accommodates the second ring 90 when the hook 108 on the upper hanger supports 107 is positioned on the first ring 88. Additionally, the hook 108 on each of the lower hanger supports 109 is positionable on the second ring 90. The upper hanger supports 107 and the lower hanger supports 109 can be spaced apart from each other and be distributed around each of the first ring 88 and the second ring 90 to maximize the number of clothes hangers 98 that can be hung on the hanging wheel 70.

An end hook 114 is included that has a plate 116 and a pair of fingers 118 each extending downwardly from the plate 116 and curving upwardly toward the plate 116. A first surface 120 of the plate 116 is coupled to the second end 38 of the bracket 12 associated with the hanger 22. Each of the fingers 118 curves upwardly toward the bracket 12 associated with the hanger 22 thereby facilitating each of the fingers 118 to support a clothes hanger 98. Additionally, a coat, purse or other type of object can be hung from either of the fingers 118 in lieu of hanging on a hanger.

In use, the wall mount 14 is mounted to the wall 16 at a desired location such that the hanger 22 is positioned at a desired height. In this way the hanging wheel 70 is suspended in a horizontal orientation at the desired height. Each of the upper hanger supports 107 and the lower hanger supports 109 is positioned on the respective first ring 88 and second ring 90 of the hanging wheel 70 and clothes hangers 98 are hung from each of the upper hanger supports 107 and the lower hanger supports 109. In this way the clothes hangers 98 can be hung in an orderly and accessible manner when a closet is not available, such as commonly occurs in studio apartments. Furthermore, the wall mount 14 can be removed from the wall 16 to relocate the wall mount 14 and the hanger 22 at any time thereby facilitating portable storage of hanging clothes 100.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A portable clothes hanging assembly for facilitating clothing to be hung in a room that does not have a closet, said assembly comprising:

a plurality of brackets being attached together to define a wall mount being attachable to a wall of a room in a building and a hange extending away from said wall mount;

a hanging wheel being rotatably attached to said hanger such that said hainging wheel has a vertical rotational axis;

a plurality of hanger supports, each of said hanger supports being suspendable from said hanging wheel, each of said hanger supports having a plurality of receivers thereby facilitating each of said receivers to receive a respective one of a plurality of clothes hangers wherein said hanging wheel is configured to facilitate the clothes hangers to hang clothes in the absensce of a closet; and wherein each of said brackets has a first wall and a pair of second walls each extending away from said first wall, said second walls being spaced apart from each other and being perpendicularly oriented with said first wall to define a channel between said pair of second walls, each of said second walls having a distal edge with respect to said first wall, each of said second walls being curled toward said first wall at a point located adjacent to said distal edge such that said distal edge of each of second walls is directed toward said first wall of a respective bracket, said first wall of each of said brackets having a plurality of holes extending through said first wall, said holes associated with each of said brackets being spaced apart from each other and being distributed between a first end and a second end of a respective bracket.

2. The assembly according to claim 1, wherein said brackets associated with said wall mount are attached together and are perpendicularly oriented with each other such that said brackets associated with said wall mount defines a cross shape, said first wall of each of said brackets associated with said wall mount abutting the wall.

3. The assembly according to claim 2, wherein said first end of said bracket associated with said hanger is secured to a respective one of said brackets associated with said wall mount such that said bracket associated with said hanger is horizontally oriented having said first wall of said bracket associated with said hanger being directed downwardly.

4. The assembly according to claim 3, wherein said bracket associated with said hanger includes a first section being attached to said respective bracket associated with said wall mount and a second section being hingedly attached to said first section, said first end of said bracket associated with said hanger being associated with said first section, said second end of said bracket associated with said hanger being associated with said second section.

5. The assembly according to claim 4, further comprising a support having a pair of bends each being spaced from a respective one of a respective primary end and a secondary end of said support thereby defining a central portion of said support extending between a pair of end portions of said support, a respective one of said end portions resting against said pair of second walls of a respective one of said brackets associated with said wall mount, a respective one of said end portions resting against said pair of second walls of said first portion of said bracket associated with said hanger.

6. The assembly according to claim 4, further comprising a pair of support attachments, each of said support attachments being attached to a respective one of said end portions of said support, a respective one of said support attachments being slidably positioned in said channel defined in a respective one of said brackets associated with said wall mount thereby attaching said support to said wall mount, a respective one of said support attachments being slidably positioned in said channel defined in said bracket being associated with said hanger such that said bracket associated with said hanger is inhibited from deflecting from said horizontal orientation, each of said support attachments being retained in said respective bracket by said distal edge of each of said second walls of said respective bracket.

7. The assembly according to claim 3, further comprising a hanger attachment being attached to said first end of said bracket associated with said hanger, said hanger attachment being slidably positioned in said channel defined in said bracket associated with said hanger thereby attaching said bracket associated with said hanger to a respective one of said brackets associated with said wall mount, said hanger attachment being retained in said bracket associated with said hanger by said distal edge of each of said second walls of said bracket associated with said hanger.

8. The assembly according to claim 4, wherein said hanging wheel comprises:

a hub being rotatably coupled to said first wall of said bracket associated with said hanger, said hub being positioned on said first section of said bracket associated with said hanger at a point located adjacent to said second section of said bracket associated with said hanger; and a plurality of arms, each of said arms having a coupled end being coupled to said hub and a distal end with respect to said hub, said arms being spaced apart from each other and being distributed around said hub, each of said arms having a foot extending downwardly from a respective arm, said foot being aligned with said distal end.

9. The assembly according to claim 8, wherein said hanging wheel comprises:

a first ring being attached to said distal end of each of said arms such that said ring surrounds said hub; and a second ring being attached to said foot on each of said arms such that said second ring is positioned beneath said first ring.

10. The assembly according to claim 9, wherein each of said hanger supports has an upper end, a lower end and an outer surface extending between said upper end and said lower end, each of said hanger supports being elongated between said upper end and said lower end, each of said hanger supports having a hook extending upwardly from said upper end and curving downwardly toward said upper end thereby facilitating said hook on each of said hanger supports to rest on a respective one of said first ring or said second ring.

11. The assembly according to claim 10, wherein each of said hanger supports has a plurality of holes each extending through said outer surface of said hanger supports to define said plurality of receivers in each of said hanger supports, said holes each of said hanger supports being spaced apart from each other and being distributed along said hanger supports.

12. The assembly according to claim 10, wherein said plurality of hanger supports including a set of upper hanger supports and a set of lower hanger supports, each of said upper hanger support having a cut out extending into said upper hanger support, said cut out being spaced from said hook on a respective upper hanger support, said cut out in each of said upper hanger supports accommodating said second ring when said hook on said upper hanger supports is positioned on said first ring, said hook on each of said lower hanger supports being positionable on said second ring.

13. The assembly according to claim 4, further comprising an end hook having a plate and a pair of fingers each extending downwardly from said plate and curving upwardly toward said plate, a first surface of said plate being coupled to said second end of said bracket associated with said hanger such that each of said fingers curves upwardly toward said bracket associated with said hanger thereby facilitating each of said fingers to support a clothes hanger.

14. A portable clothes hanging assembly for facilitating clothing to be hung in a room that does not have a closet, said assembly comprising:

a plurality of brackets being attached together to define a wall mount being attachable to a wall of a room in a building and a hanger extending away from said wall mount, each of said brackets having a first wall and a pair of second walls each extending away from said first wall, said second walls being spaced apart from each other and being perpendicularly oriented with said first wall to define a channel between said pair of second walls, each of said second walls having a distal edge with respect to said first wall, each of said second walls being curled toward said first wall at a point located adjacent to said distal edge such that said distal edge of each of second walls is directed toward said first wall of a respective bracket, said first wall of each of said brackets having a plurality of holes extending through said first wall, said holes associated with each of said brackets being spaced apart from each other and being distributed between a first end and a second end of a respective bracket, said brackets associated with said wall mount being attached together and being perpendicularly oriented with each other such that said brackets associated with said wall mount defines a cross shape, said first wall of each of said brackets associated with said wall mount abutting the wall, said first end of said bracket associated with said hanger being secured to a respective one of said brackets associated with said wall mount such that said bracket associated with said hanger is horizontally oriented having said first wall of said bracket associated with said hanger being directed downwardly, said bracket associated with said hanger including a first section being attached to said respective bracket associated with said wall mount and a second section being hingedly attached to said first section, said first end of said bracket associated with said hanger being associated with said first section, said second end of said bracket associated with said hanger being associated with said second section;

a support having a pair of bends each being spaced from a respective one of a respective primary end and a secondary end of said support thereby defining a central portion of said support extending between a pair of end portions of said support, a respective one of said end portions resting against said pair of second walls of a respective one of said brackets associated with said wall mount, a respective one of said end portions resting against said pair of second walls of said first portion of said bracket associated with said hanger;

a pair of support attachments, each of said support attachments being attached to a respective one of said end portions of said support, a respective one of said support attachments being slidably positioned in said channel defined in a respective one of said brackets associated with said wall mount thereby attaching said support to said wall mount, a respective one of said support attachments being slidably positioned in said channel defined in said bracket being associated with said hanger such that said bracket associated with said hanger is inhibited from deflecting from said horizontal orientation, each of said support attachments being retained in said respective bracket by said distal edge of each of said second walls of said respective bracket;

a hanger attachment being attached to said first end of said bracket associated with said hanger, said hanger attachment being slidably positioned in said channel defined in said bracket associated with said hanger thereby attaching said bracket associated with said hanger to a respective one of said brackets associated with said wall mount, said hanger attachment being retained in said bracket associated with said hanger by said distal edge of each of said second walls of said bracket associated with said hanger;

a hanging wheel being rotatably attached to said hanger such that said hanging wheel has a vertical rotational axis, said hanging wheel comprising:

a hub being rotatably coupled to said first wall of said bracket associated with said hanger, said hub being positioned on said first section of said bracket associated with said hanger at a point located adjacent to said second section of said bracket associated with said hanger;

a plurality of arms, each of said arms having a coupled end being coupled to said hub and a distal end with respect to said hub, said arms being spaced apart from each other and being distributed around said hub, each of said arms having a foot extending downwardly from a respective arm, said foot being aligned with said distal end;

a first ring being attached to said distal end of each of said arms such that said ring surrounds said hub; and a second ring being attached to said foot on each of said arms such that said second ring is positioned beneath said first ring;

a plurality of hanger supports, each of said hanger supports being suspendable from said hanging wheel, each of said hanger supports having a plurality of receivers thereby facilitating each of said receivers to receive a respective one of a plurality of clothes hangers wherein said hanging wheel is configured to facilitate the clothes hangers to hang clothes in the absence of a closet, each of said hanger supports having an upper end, a lower end and an outer surface extending between said upper end and said lower end, each of said hanger supports being elongated between said upper end and said lower end, each of said hanger supports having a hook extending upwardly from said upper end and curving downwardly toward said upper end thereby facilitating said hook on each of said hanger supports to rest on a respective one of said first ring or said second ring, each of said hanger supports having a plurality of holes each extending through said outer surface of said hanger supports to define said plurality of receivers in each of said hanger supports, said holes each of said hanger supports being spaced apart from each other and being distributed along said hanger supports, said plurality of hanger supports including a set of upper hanger supports and a second of lower hanger supports, each of said upper hanger support having a cut out extending into said upper hanger support, said cut out being spaced from said hook on a respective upper hanger support, said cut out in each of said upper hanger supports accommodating said second ring when said hook on said upper hanger supports is positioned on said first ring, said hook on each of said lower hanger supports being positionable on said second ring; and an end hook having a plate and a pair of fingers each extending downwardly from said plate and curving upwardly toward said plate, a first surface of said plate being coupled to said second end of said bracket associated with said hanger such that each of said fingers curves upwardly toward said bracket associated with said hanger thereby facilitating each of said fingers to support a clothes hanger.

* * * * *